US006643998B1

(12) United States Patent
Curtis et al.

(10) Patent No.: US 6,643,998 B1
(45) Date of Patent: Nov. 11, 2003

(54) PACKAGING APPARATUS

(76) Inventors: Fred P. Curtis, 8138 Sharondale, Houston, TX (US) 77033; Howard E. Green, Jr., 8138 Sharondale, Houston, TX (US) 77033

( * ) Notice: Subject to any disclaimer, the term of this patent is extended or adjusted under 35 U.S.C. 154(b) by 0 days.

(21) Appl. No.: 10/142,457

(22) Filed: May 10, 2002

(51) Int. Cl.[7] ..... B65B 11/00

(52) U.S. Cl. ..... 53/594; 53/58; 53/432; 53/434; 53/397; 53/441

(58) Field of Search ..... 53/432, 434, 58, 53/594, 557, 397, 441

(56) References Cited

U.S. PATENT DOCUMENTS 2,790,284 A 4/1957 Hultkrans
3,377,769 A 4/1968 Bridgeman
3,712,020 A * 1/1973 Norr et al. ..... 53/412
5,239,808 A 8/1993 Wells et al.
5,250,310 A 10/1993 Fujino
5,269,314 A 12/1993 Kendall et al.
5,486,659 A * 1/1996 Rosenbush ..... 181/131
5,664,408 A 9/1997 Chesterfield et al.
6,145,280 A * 11/2000 Daroux et al. ..... 53/433
6,467,568 B1 * 10/2002 Kemper ..... 181/131

* cited by examiner

*Primary Examiner*—Eugene Kim
*Assistant Examiner*—Christopher Harmon

(57) ABSTRACT

A packaging apparatus for enclosing a head portion of a stethoscope in a barrier material. The packaging apparatus includes a housing having an interior with an opening for allowing the insertion of a head portion of a stethoscope into the interior. A sensor assembly detects the insertion of the head portion of the stethoscope. A door assembly selectively closes the opening. The door assembly comprises a door member and a door actuator. The door member is movable between an open position and a closed position. A vacuum assembly evacuates air from the interior. A table member supports a section of a roll of barrier material comprising individual plastic sleeves. A feed assembly positions the barrier material. A handling assembly manipulates an open end of the sleeves. The handling assembly includes an upper attachment member and a lower attachment member for releasably attaching to top and bottom sides of the open end of the sleeve respectively. A control device controls each of the assemblies in a sequential manner.

20 Claims, 6 Drawing Sheets

PACKAGING APPARATUS

BACKGROUND OF THE INVENTION

1. Field of the Invention

The present invention relates to packaging devices and more particularly pertains to a new packaging apparatus for enclosing a head portion of a stethoscope in a barrier material.

2. Description of the Prior Art

The use of packaging devices is known in the prior art. U.S. Pat. No. 5,664,408 describes an apparatus for vacuum packaging a soft product. Another type of packaging devices is U.S. Pat. No. 5,239,808 details a vacuum packaging apparatus provided for use in evacuating the air in an open package and sealing the evacuated package.

While these devices fulfill their respective, particular objectives and requirements, the need remains for a device for temporarily sealing objects for short-term uses.

SUMMARY OF THE INVENTION

The present invention meets the needs presented above by incorporating a sealing means which fully encloses the object but does not seal the open end allowing the user to easily remove the packaging after a one-time use.

Still yet another object of the present invention is to provide a new packaging apparatus that isolates the user from any unwanted debris that has accumulated on the packaged object, such as enclosing a head portion of a stethoscope or other medical instrument in a protective barrier to protect the patient from germs and bacteria that may be on the instrument from a previous use.

Even still another object of the present invention is to provide a new packaging apparatus that allows the user to quickly and easily package the object for a one-time use, making for more efficient use of the user's time.

To this end, the present invention generally comprises a housing having an interior with an opening for allowing the insertion of a head portion of a stethoscope into the interior. A sensor assembly detects the insertion of the head portion of the stethoscope. A door assembly selectively closes the opening. The door assembly comprises a door member and a door actuator. The door member is movable between an open position and a closed position. A vacuum assembly evacuates air from the interior. A table member supports a section of a roll of barrier material comprising individual plastic sleeves. A feed assembly positions the barrier material. A handling assembly manipulates an open end of the sleeves. The handling assembly includes an upper attachment member and a lower attachment member for releasably attaching to top and bottom sides of the open end of the sleeve respectively. A control device controls each of the assemblies in a sequential manner.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
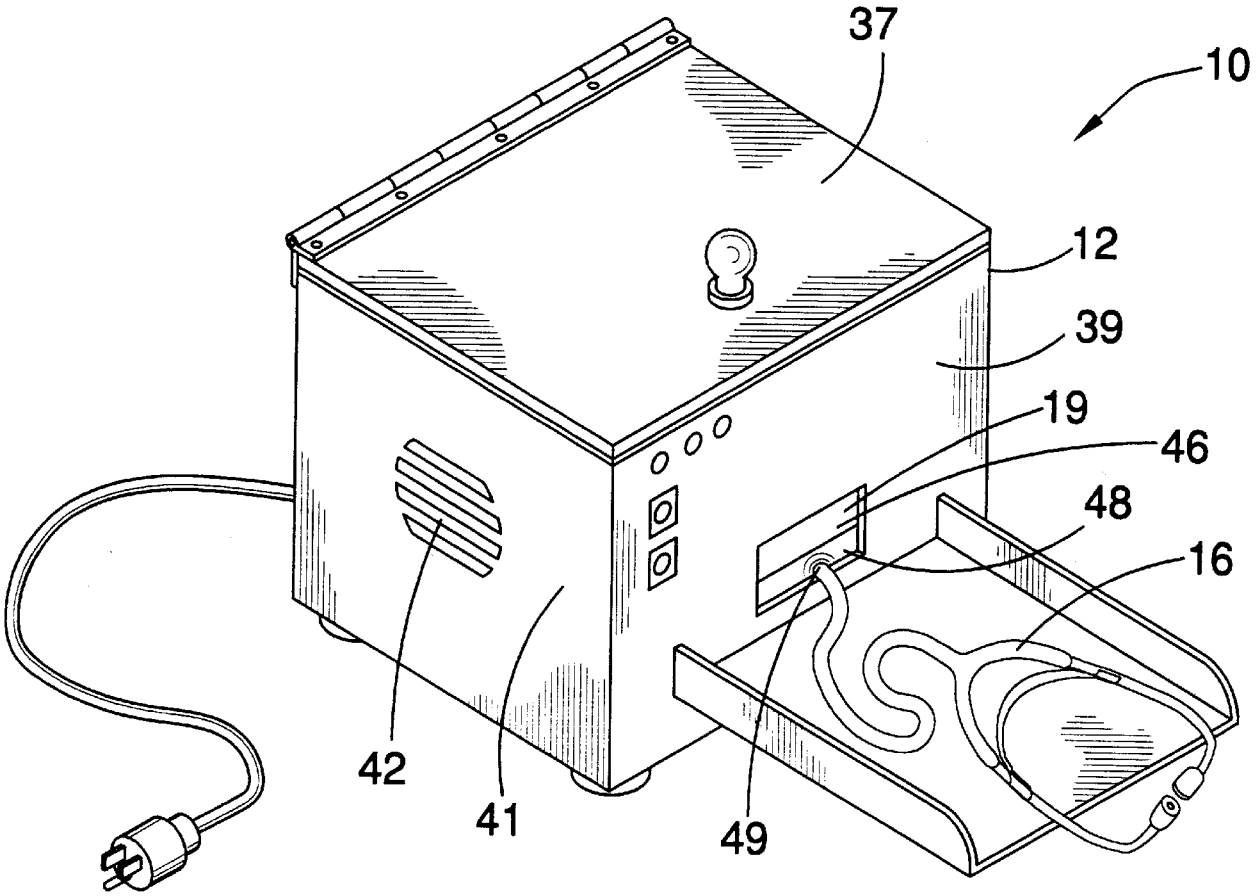
FIG. 1 is a schematic perspective view of a new packaging apparatus according to the present invention.
Figure 2:
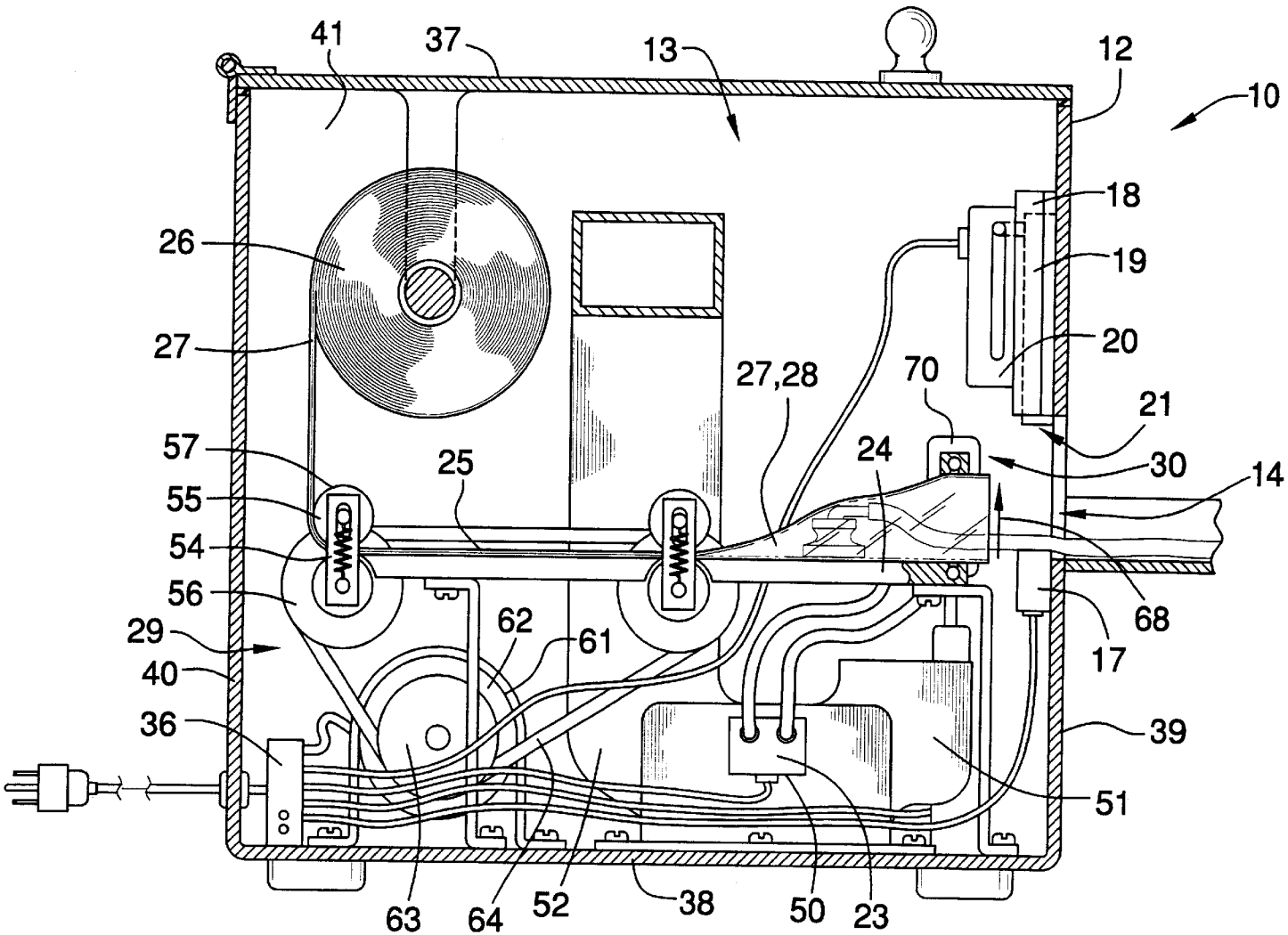
FIG. 2 is a schematic cross-sectional side view of the present invention.
Figure 3:
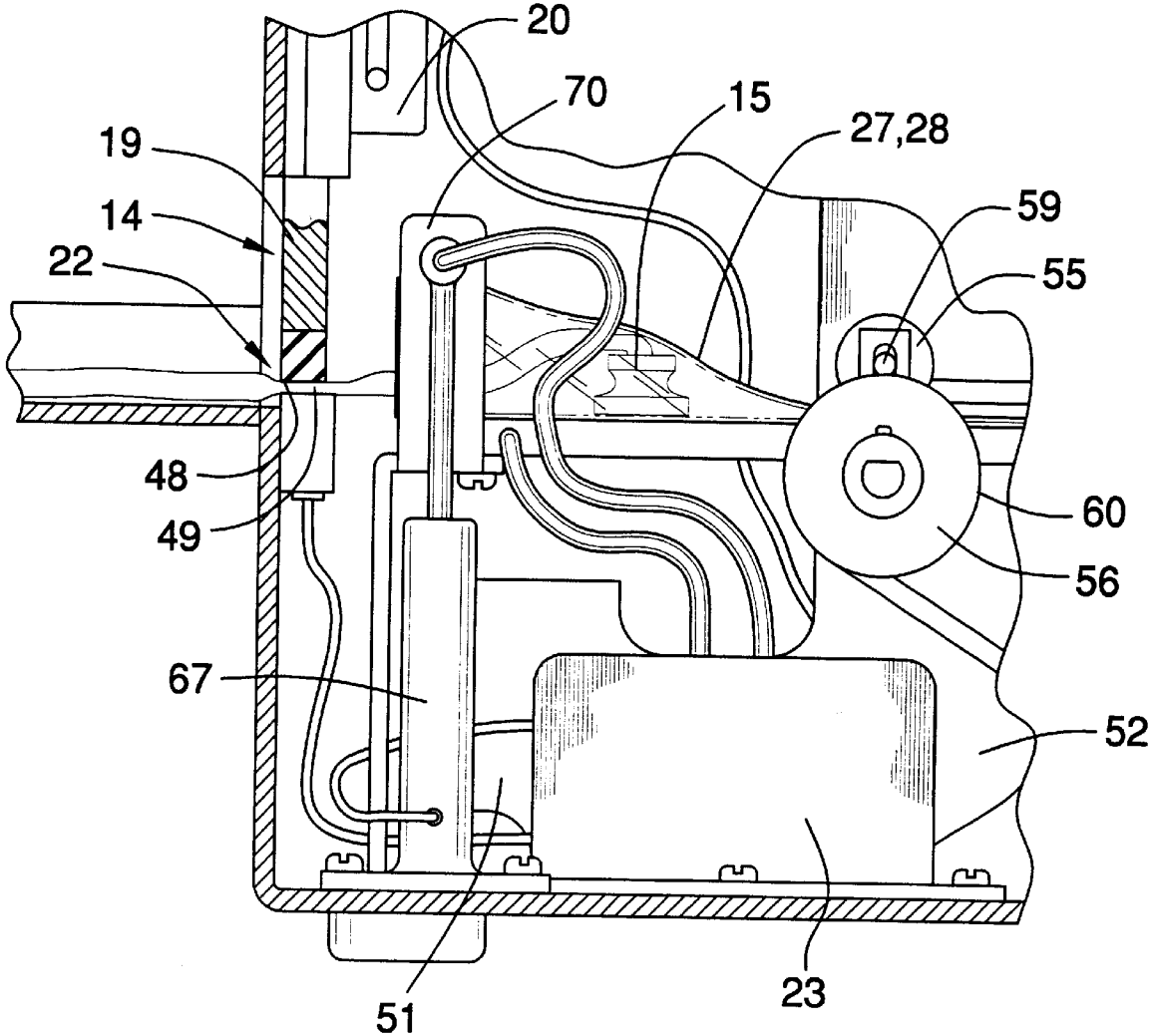
FIG. 3 is a schematic first sectional side view of the present invention.
Figure 4:
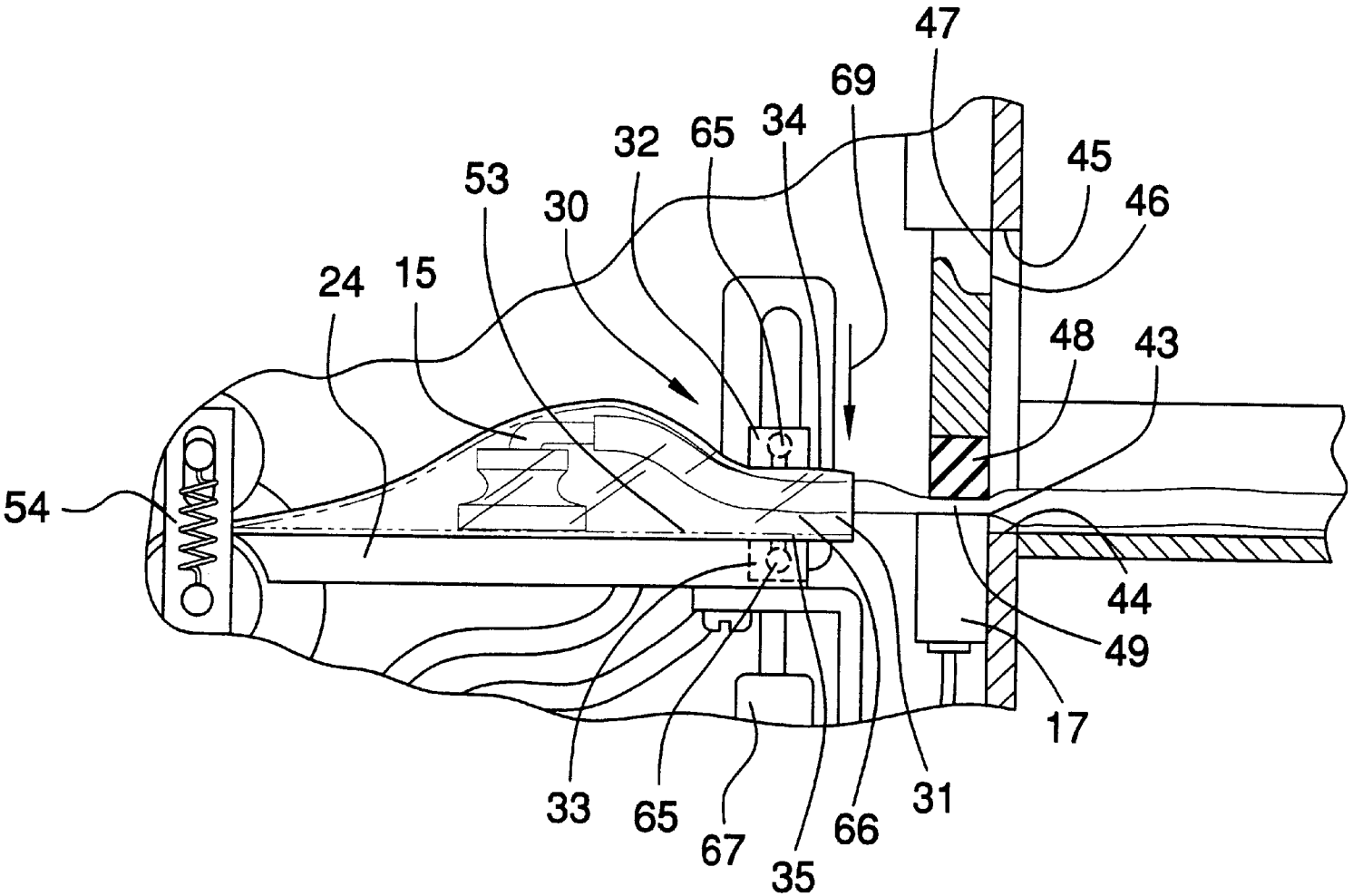
FIG. 4 is a schematic second sectional side view of the present invention.
Figure 5:
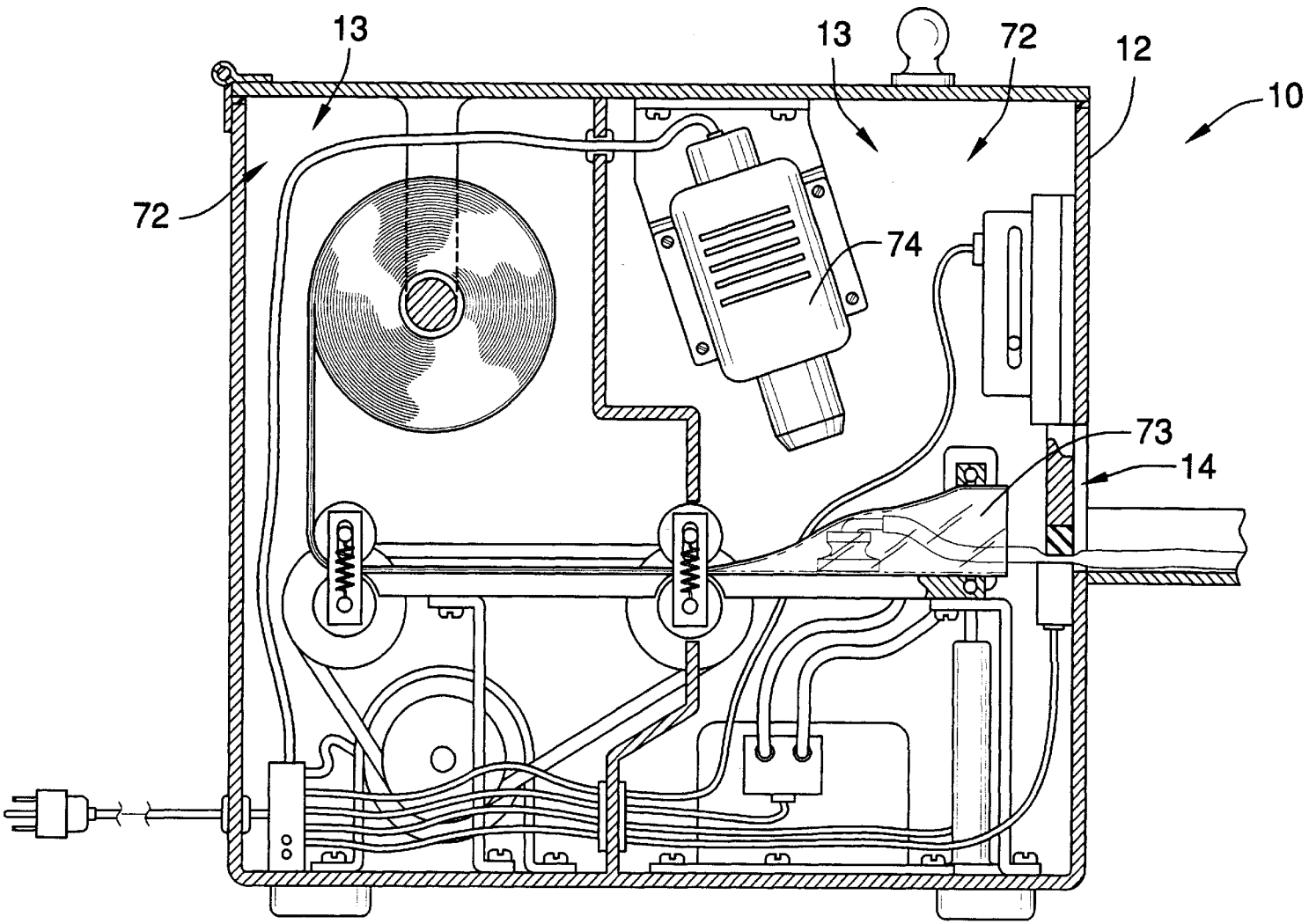
FIG. 5 is a schematic cross-sectional side view of an alternate embodiment of the present invention.
Figure 6:
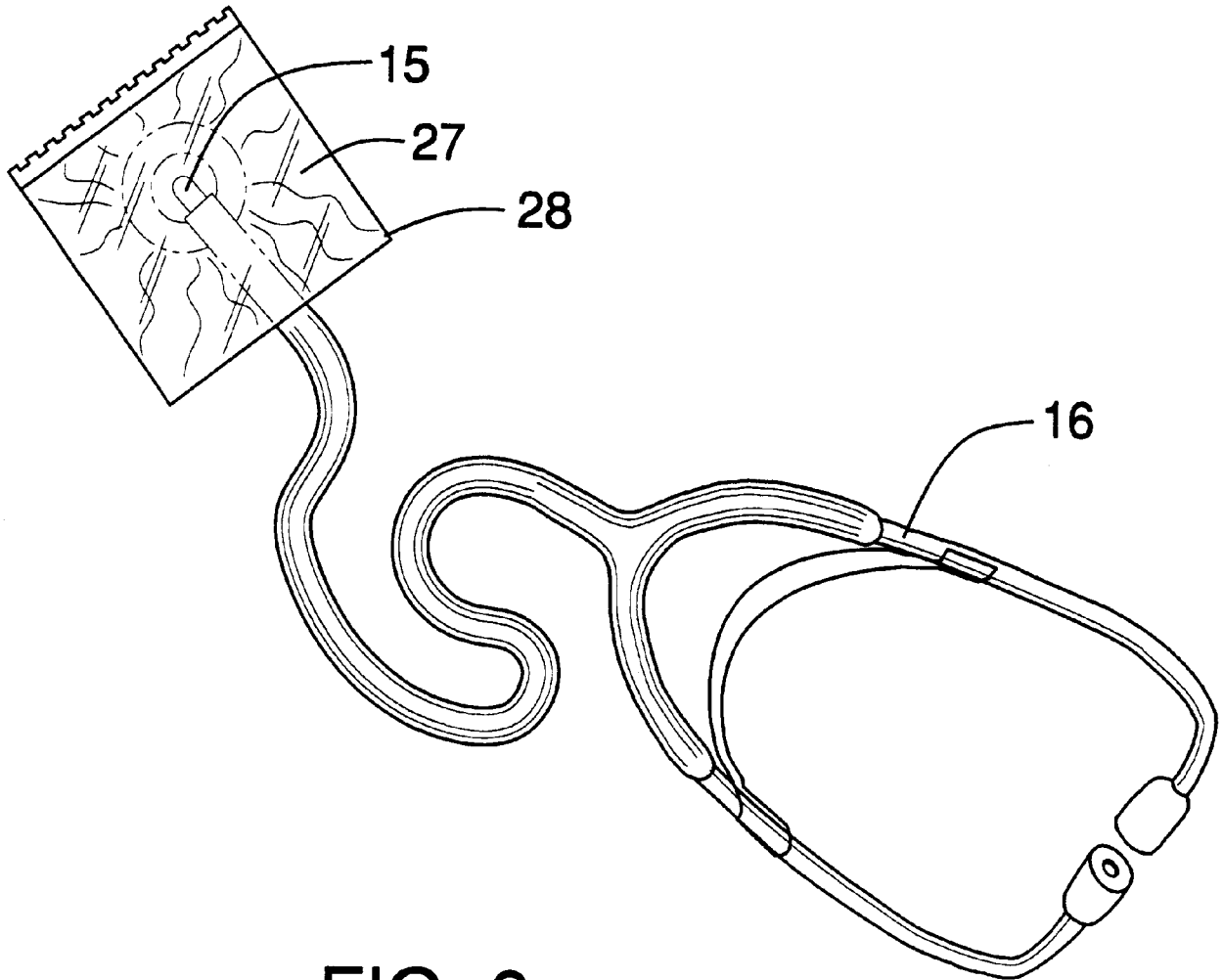
FIG. 6 is a schematic perspective view of a stethoscope with the head portion enclosed by the barrier wrapping material.

With reference now to the drawings, and in particular to FIGS. 1 through 6 thereof, a new packaging apparatus embodying the principles and concepts of the present invention and generally designated by the reference numeral 10 will be described.

As best illustrated in FIGS. 1 through 6, the packaging apparatus 10 generally comprises a housing 12 having an interior 13 with an opening 14 for allowing the insertion of a head portion 15. of a stethoscope 16 into the interior 13.

A sensor assembly 17 detects the insertion of the head portion 15 of the stethoscope 16 through the opening 14 in the housing 12.

A door assembly 18 selectively closes the opening 14 in the housing 12. The door assembly 18 comprises a door member 19 and a door actuator 20. The door member 19 is slidably movable between an open position 21 and a closed position 22.

A vacuum assembly 23 evacuates air from the interior 13 of the housing 12.

An elongate table member 24 supports a laid-out section 25 of a roll 26 of barrier material 27 comprising individual plastic sleeves 28.

A feed assembly 29 movably positions the barrier material 27.

A handling assembly 30 manipulates an open end 31 of one of the individual sleeves 28 of the barrier material 27. The handling assembly 30 includes an upper attachment member 32 and a lower attachment member 33 for releasably attaching to top and bottom sides 34, 35 of the open end 31 of the sleeve 28 respectively. A control device 36 controls each of the assemblies in a sequential manner.

The housing 12 has a top wall 37, a bottom wall 38, a front wall 39, a back wall 40, and a pair of side walls 41 to define the interior 13. The opening 14 is positioned in the front wall 39. The housing 12 has a vent 42 for fluidly coupling the interior 13 to exterior ambient air. The housing 12 comprises stainless steel.

The sensor assembly 17 is electrically coupled to the control device 36. The sensor assembly 17 detects the presence and movement of an object positioned adjacent to an upper surface 43 of the sensor assembly 17 so that appropriate signals are transmitted to the control device 36. The sensor assembly 17 is mounted on the front wall 39 and is positioned adjacent to a bottom edge 44 of the opening 14. The upper surface 43 is oriented generally parallel to the bottom edge 44 of the opening 14.

The door assembly 18 is mounted on the front wall 39 and is positioned adjacent to a top edge 45 of the opening 14. The door member 19 is generally larger than the opening 14 such that the opening 14 is substantially covered when the door is in the closed position 22. An outer surface 46 of the door member 19 abuts an inside surface 47 of the front wall 39 such that a seal is formed between the door member 19 and the housing 12 when the door is in the closed position 22. A bottom section 48 of the door member 19 comprises a resiliently elastomeric material such that the bottom section 48 is conformable to a shape of a medial portion 49 of the stethoscope 16 when positioned under the door member 19 so that a snug fit is formed about the medial portion 49 between the bottom section 48 and the sensor assembly 17 when the door is in the closed position 22.

The door member 19 being slidably moved upward away from the bottom edge 44 of the opening 14 characterizes the open position 21.

The closed position 22 is characterized by the door member 19 being slidably moved downward until the bottom section 48 of the door member 19 abuts the upper surface 43 of the sensor assembly 17 and the door member 19 substantially covers the opening 14 in the housing 12.

The door actuator 20 is operationally coupled to the door member 19 such that the door actuator 20 is designed for slidably moving the door member 19 between the open position 21 and the closed position 22. The door actuator 20 is electrically coupled to the control device 36 such that activation of the door actuator 20 biases the door member 19 into the closed position 22. The door actuator 20 comprises an electromechanical spring-return solenoid.

The vacuum assembly 23 comprises a vacuum member 50, an intake portion 51, and an exhaust portion 52. The intake and exhaust portions 52 are fluidly coupled to the vacuum member 50. The intake portion 51 is in fluid communication with the interior 13 of the housing 12. The exhaust portion 52 is fluidly coupled to the vent 42 of the housing 12 such that the vacuum assembly 23 is in fluid communication with the exterior ambient air. The vacuum member 50 is electrically coupled to the control device 36. Wherein interior air is pulled through the intake portion 51 by the vacuum member 50 and exhausted through the vent 42 when the vacuum is activated to create a negative air pressure condition in the interior 13.

The table member 24 is mounted on the bottom wall 38 and is positioned proximate to the front wall 39 and extends towards the back wall 40. A top surface 53 of the table member 24 is positioned at a height generally equal to a height of the bottom edge 44 of the opening 14 and is oriented generally parallel to the bottom edge 44. A longitudinal axis of the table member 24 is generally perpendicular to the front wall 39. A width of the table member 24 is generally greater than a width of the barrier material 27.

The feed assembly 29 includes at least two guide mechanisms 54 for guiding the barrier material 27 from the roll 26 onto the table member 24 towards the opening 14 in the housing 12.

Each of the guide mechanisms 54 comprises a roller member 55 and a guide pulley 56, each being rotatably coupled to the table member 24.

Each of the roller members 55 are positioned adjacent to the top surface 53 of the table member 24 and is oriented substantially perpendicular to the longitudinal axis of the table member 24.

An outer surface 46 of each of the roller members 55 abuts the top surface 53 of the table member 24 so that the barrier material 27 is securely positionable between each of the roller members 55 and the table member 24.

A first end 59 of each of the roller members 55 abuts an outer edge 60 of each of the guide pulleys 56 such that each of the roller members 55 is operationally coupled to an associated one of the guide pulleys 56.

The feed assembly 29 includes a drive member 61 mounted on the bottom wall 38. The drive member 61 comprises a motor 62 and a drive pulley 63 that are operationally coupled together. The feed assembly 29 includes an endless belt 64 for engaging the drive pulley 63 and each of the guide pulleys 56. The motor 62 is electrically coupled to the control device 36 such that the barrier material 27 is movable from the roll 26 through each of the guide mechanisms 54 toward the opening 14 in an incremental manner.

Each of the attachment members 32, 33 of the handling assembly 30 has an elongate vacuum portion 65 that is fluidly coupled to the vacuum assembly 23. The lower attachment member 33 is mounted on a front end 66 of the table member 24 and is oriented substantially perpendicular to the longitudinal axis of the table member 24. The bottom side 35 of the open end 31 of the sleeve 28 is held in position atop the vacuum portion 65 of the lower attachment member 33 when suction is applied to the lower attachment member 33.

The handling assembly 30 has a positioning member 67 for selectively positioning the upper attachment member 32 between a raised position 68 above the table member 24 and a lowered position 69 proximate to the table member 24. The positioning member 67 is electrically coupled to the control device 36 and is mounted on the bottom wall 38 of the housing 12 adjacent to the first end 59 of the table member 24. The upper attachment member 32 is fixedly coupled to and extends away from a top end 70 of the positioning member 67 in a substantially perpendicular manner such that the upper attachment member 32 is substantially aligned with the lower attachment member 33.

The top side 34 of the open end 31 of the sleeve 28 is releasably attachable to the upper attachment member 32 when the lower attachment member 33 is positioned adjacent to the top side 34 of the open end 31 of the sleeve 28 and suction is applied to the upper attachment member 32.

The open end 31 of the sleeve 28 is expandable to facilitate insertion of the head portion 15 of the stethoscope 16 into the sleeve 28 when the top side 34 of the open end 31 is moved upward away from the bottom side 35 by the upper attachment member 32.

In use, a user inserts the head portion 15 of the stethoscope 16 through the opening 14, which upon detection of the medial portion 49 of the stethoscope 16 by the sensor assembly 17 causes the handling assembly 30 to expand the end of the sleeve 28 so the head portion 15 can be positioned inside. After the sensor assembly 17 detects a lack of movement of the medial portion 49 of the stethoscope 16, the door assembly 18 closes sealing the opening 14.

The vacuum assembly 23 then evacuates all the air from the interior 13, during which time the handling assembly 30 moves into the lowered position 69. This results in the head portion 15 being generally sealed inside the sleeve 28.

After the control device 36 determines that the process is complete by either a pressure difference indication or simply a predetermined process time limit expiring, the door assembly 18 opens. The feed assembly 29 then advances the barrier material 27 to allow the user to separate the adjoining sleeves 28.

The user can then utilize the stethoscope 16 on the next patient in a more sanitary manner than without the barrier being present. The sleeve 28 is removed and disposed of due to the fact that the open end 31 of the sleeve 28 is not fully sealed. The process is repeated for each use of the stethoscope 16, or any similar instrument or item for which a user may deem appropriate.

Therefore, although a specific application of the invention was described in detail herein, it is most apparent that a wide variety of similar applications exist.

In an alternate embodiment, the housing 12 has two separate chambers 72 and a heat-activated shrink wrap 73 is utilized in conjunction with a heating device 74 to seal the object in the wrap versus utilizing the vacuum sealing method. All other functions of the apparatus remain the same.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A packaging apparatus for enclosing a head portion of a stethoscope in a barrier material, wherein the barrier material comprises a continuous roll of individual plastic sleeves having adjoined perforated edges, said packaging apparatus comprising:

a housing having an interior, said housing having an opening for allowing the insertion of the head portion of the stethoscope into said interior;

a sensor assembly for detecting the insertion of the head portion of the stethoscope through said opening in said housing;

a door assembly for selectively closing said opening in said housing, said door assembly comprising a door member and a door actuator, said door member being slidably movable between an open position and a closed position;

a vacuum assembly for evacuating air from said interior of said housing;

an elongate table member for supporting a laid-out section of the barrier material;

a feed assembly for movably positioning the barrier material;

a handling assembly for manipulating an open end of one of the individual sleeves of the barrier material, said handling assembly including an upper attachment member and a lower attachment member for releasably attaching to top and bottom sides of the open end of the sleeve respectively;

a control device for controlling each of said assemblies in a sequential manner; and wherein when the head portion of the stethoscope is inserted through said opening, said sensor initiates said control device to sequentially activate each of said assemblies to enclose the head portion in the barrier material.

2. The packaging apparatus as set forth in claim 1, further comprising said housing having a top wall, a bottom wall, a front wall, a back wall, and a pair of side walls to define said interior, said opening being positioned in said front wall, said housing having a vent for fluidly coupling said interior to exterior ambient air, said housing comprising stainless steel.

3. The packaging apparatus as set forth in claim 2, further comprising said sensor being electrically coupled to said control device, wherein said sensor assembly detects the presence and movement of an object positioned adjacent to an upper surface of said sensor assembly so that appropriate signals are transmitted to said control device, said sensor assembly being mounted on said front wall and being positioned adjacent to a bottom edge of said opening, said upper surface being oriented generally parallel to said bottom edge of said opening.

4. The packaging apparatus as set forth in claim 2, further comprising said door assembly being mounted on said front wall and being positioned adjacent to a top edge of said opening, said door member being generally larger than said opening such that said opening is substantially covered when said door is in said closed position, an outside surface of said door member abutting an inside surface of said front wall such that a seal is formed between said door member and said housing when said door is in said closed position.

5. The packaging apparatus as set forth in claim 1, further comprising a bottom section of said door member comprising a resiliently elastomeric material such that said bottom section is conformable to a shape of a medial portion of the stethoscope when positioned under said door member so that a snug fit is formed about the medial portion between said bottom section and said sensor assembly when said door is in said closed position.

6. The packaging apparatus as set forth in claim 1, wherein said open position is characterized by said door member being slidably moved upward away from a bottom edge of said opening, and said closed position is characterized by said door member being slidably moved downward until said door member abuts said sensor assembly and said door member substantially covers said opening.

7. The packaging apparatus as set forth in claim 1, further comprising said door actuator being operationally coupled to said door member such that said door actuator is adapted for slidably moving said door member between said open and closed positions, said door actuator being electrically coupled to said control device such that activation of said door actuator biases said door member into said closed position, said door actuator member comprising an electromechanical spring-return solenoid.

8. The packaging apparatus as set forth in claim 1, further comprising said vacuum assembly comprising a vacuum member, an intake portion, and an exhaust portion, said intake and exhaust portions being fluidly coupled to said vacuum member, said intake portion being in fluid communication with said interior of said housing, said exhaust portion being fluidly coupled to a vent of said housing such that said vacuum assembly is in fluid communication with the exterior ambient air;

said vacuum member being electrically coupled to said control device; and wherein interior air is pulled through said intake portion by said vacuum member and exhausted through said vent when said vacuum is activated to create a negative air pressure condition in said interior.

9. The packaging apparatus as set forth in claim 3, further comprising said table member being mounted on said bottom wall positioned proximate to said front wall and extending towards said back wall, a top surface of said table member being positioned at a height generally equal to a height of said bottom edge of said opening and being oriented generally parallel to said bottom edge, a longitudinal axis of said table member being generally perpendicular to said front wall, a width of said table member being generally greater than a width of the barrier material.

10. The packaging apparatus as set forth in claim 1, further comprising said feed assembly including at least two guide mechanisms for guiding the barrier material from the roll onto said table member towards said opening in said housing, each of said guide mechanisms comprising a roller member and a guide pulley each being rotatably coupled to said table member, each of said roller members being positioned adjacent to said top surface of said table member and being oriented substantially perpendicular to said longitudinal axis of said table member.

11. The packaging apparatus as set forth in claim 10, further comprising an outer surface of each of said roller members abutting said top surface of said table member so that the barrier material is securely positionable between each of said roller members and said table member.

12. The packaging apparatus as set forth in claim 10, further comprising a first end of each of said roller members abutting an outer edge of each of said guide pulleys such that each of said roller members is operationally coupled to an associated one of said guide pulleys.

13. The packaging apparatus as set forth in claim 1, further comprising said feed assembly including a drive member being mounted on a bottom wall of said housing, said drive member comprising a motor and a drive pulley being operationally coupled together, said feed assembly including an endless belt for engaging said drive pulley and each of said guide pulleys, said motor being electrically coupled to said control device such that the barrier material is movable from the roll through each of said guide mechanisms toward said opening in an incremental manner.

14. The packaging apparatus as set forth in claim 1, further comprising each of said attachment members of said handling assembly having an elongate vacuum portion being fluidly coupled to said vacuum assembly.

15. The packaging apparatus as set forth in claim 1, further comprising said lower attachment member being mounted on a front end of said table member and being oriented substantially perpendicular to said longitudinal axis of said table member, wherein the bottom side of the open end of the sleeve is held in position atop said vacuum portion of said lower attachment member when suction is applied to said lower attachment member.

16. The packaging apparatus as set forth in claim 1, further comprising said handling assembly having a positioning member for selectively positioning said upper attachment member between a raised position above said table member and a lowered position proximate to said table member, said positioning member being electrically coupled to said control device and being mounted on a bottom wall of said housing adjacent to said front end of said table member.

17. The packaging apparatus as set forth in claim 16, further comprising said upper attachment member being fixedly coupled to and extending away from a top end of said positioning member in a substantially perpendicular manner such that said upper attachment member is substantially aligned with said lower attachment member, wherein the top side of the open end of the sleeve is releasably attachable to said upper attachment member when said lower attachment member is positioned adjacent to the top side of the open end of the sleeve and suction is applied to said upper attachment member.

18. The packaging apparatus as set forth in claim 1, further comprising wherein the open end of the sleeve is expandable to facilitate insertion of the head portion of the stethoscope into the sleeve when the top side of the open end is moved upward away from the bottom side by said upper attachment member, wherein a user inserts the head portion of the stethoscope through said opening and upon completion of a vacuum-sealing cycle separates the individual sealed sleeve containing the head portion from the adjoining sleeve.

19. A packaging apparatus for enclosing a head portion of a stethoscope in a barrier material, wherein the barrier material comprises a continuous roll of individual plastic shrink-wrap sleeves having adjoined perforated edges, said packaging apparatus comprising:

a housing having a first compartment and a second compartment, said housing having an opening for allowing the insertion of the head portion of the stethoscope into said first compartment;

a sensor assembly for detecting the insertion of the head portion of the stethoscope through said opening in said housing;

a door assembly for selectively closing said opening in said housing;

a feed assembly for movably positioning the barrier material;

a handling assembly for manipulating an open end of one of the individual shrink-wrap sleeves of the barrier material;

a heating apparatus for heat-shrinking the shrink-wrap sleeves about the head portion of the stethoscope;

a control device for controlling each of said assemblies in a sequential manner;

wherein when the head portion of the stethoscope is inserted through said opening, said sensor initiates said control device to sequentially activate each of said assemblies to enclose the head portion in the barrier material.

20. A packaging apparatus for enclosing a head portion of a stethoscope in a barrier material, wherein the barrier material comprises a continuous roll of individual plastic sleeves having adjoined perforated edges, said packaging apparatus comprising:

a housing having an interior, said housing having an opening for allowing the insertion of the head portion of the stethoscope into said interior;

a sensor assembly for detecting the insertion of the head portion of the stethoscope through said opening in said housing;

a door assembly for selectively closing said opening in said housing, said door assembly comprising a door member and a door actuator, said door member being slidably movable between an open position and a closed position;

a vacuum assembly for evacuating air from said interior of said housing;

an elongate table member for supporting a laid-out section of the barrier material;

a feed assembly for movably positioning the barrier material;

a handling assembly for manipulating an open end of one of the individual sleeves of the barrier material, said handling assembly including an upper attachment member and a lower attachment member for releasably attaching to top and bottom sides of the open end of the sleeve respectively;

a control device for controlling each of said assemblies in a sequential manner;

wherein when the head portion of the stethoscope is inserted through said opening, said sensor initiates said control device to sequentially activate each of said assemblies to enclose the head portion in the barrier material;

said housing having a top wall, a bottom wall, a front wall, a back wall, and a pair of side walls to define said interior, said opening being positioned in said front wall, said housing having a vent for fluidly coupling said interior to exterior ambient air, said housing comprising stainless steel;

said sensor being electrically coupled to said control device, wherein said sensor assembly detects the presence and movement of an object positioned adjacent to an upper surface of said sensor assembly so that appropriate signals are transmitted to said control device, said sensor assembly being mounted on said front wall and being positioned adjacent to a bottom edge of said opening, said upper surface being oriented generally parallel to said bottom edge of said opening;

said door assembly being mounted on said front wall and being positioned adjacent to a top edge of said opening, said door member being generally larger than said opening such that said opening is substantially covered when said door is in said closed position, an outside surface of said door member abutting an inside surface of said front wall such that a seal is formed between said door member and said housing when said door is in said closed position, a bottom section of said door member comprising a resiliently elastomeric material such that said bottom section is conformable to a shape of a medial portion of the stethoscope when positioned under said door member so that a snug fit is formed about the medial portion between said bottom section and said sensor assembly when said door is in said closed position, wherein said open position is characterized by said door member being slidably moved upward away from said bottom edge of said opening, and said closed position is characterized by said door member being slidably moved downward until said bottom section of said door member abuts said upper surface of said sensor assembly and said door member substantially covers said opening in said housing, said door actuator being operationally coupled to said door member such that said door actuator is adapted for slidably moving said door member between said open and closed positions, said door actuator being electrically coupled to said control device such that activation of said door actuator biases said door member into said closed position, said door actuator member comprising an electromechanical spring-return solenoid;

said vacuum assembly comprising a vacuum member, an intake portion, and an exhaust portion, said intake and exhaust portions being fluidly coupled to said vacuum member, said intake portion being in fluid communication with said interior of said housing, said exhaust portion being fluidly coupled to said vent of said housing such that said vacuum assembly is in fluid communication with the exterior ambient air, said vacuum member being electrically coupled to said control device, wherein interior air is pulled through said intake portion by said vacuum member and exhausted through said vent when said vacuum is activated to create a negative air pressure condition in said interior;

said table member being mounted on said bottom wall positioned proximate to said front wall and extending towards said back wall, a top surface of said table member being positioned at a height generally equal to a height of said bottom edge of said opening and being oriented generally parallel to said bottom edge, a longitudinal axis of said table member being generally perpendicular to said front wall, a width of said table member being generally greater than a width of the barrier material;

said feed assembly including at least two guide mechanisms for guiding the barrier material from the roll onto said table member towards said opening in said housing, each of said guide mechanisms comprising a roller member and a guide pulley each being rotatably coupled to said table member, each of said roller members being positioned adjacent to said top surface of said table member and being oriented substantially perpendicular to said longitudinal axis of said table member, an outer surface of each of said roller members abutting said top surface of said table member so that the barrier material is securely positionable between each of said roller members and said table member, a first end of each of said roller members abutting an outer edge of each of said guide pulleys such that each of said roller members is operationally coupled to an associated one of said guide pulleys, said feed assembly including a drive member being mounted on said bottom wall, said drive member comprising a motor and a drive pulley being operationally coupled together, said feed assembly including an endless belt for engaging said drive pulley and each of said guide pulleys, said motor being electrically coupled to said control device such that the barrier material is movable from the roll through each of said guide mechanisms toward said opening in an incremental manner; and each of said attachment members of said handling assembly having an elongate vacuum portion being fluidly coupled to said vacuum assembly, said lower attachment member being mounted on a front end of said table member and being oriented substantially perpendicular to said longitudinal axis of said table member, wherein the bottom side of the open end of the sleeve is held in position atop said vacuum portion of said lower attachment member when suction is applied to said lower attachment member, said handling assembly having a positioning member for selectively positioning said upper attachment member between a raised position above said table member and a lowered position proximate to said table member, said positioning member being electrically coupled to said control device and being mounted on said bottom wall of said housing adjacent to said front end of said table member, said upper attachment member being fixedly coupled to and extending away from a top end of said positioning member in a substantially perpendicular manner such that said upper attachment member is substantially aligned with said lower attachment member, wherein the top side of the open end of the sleeve is releasably attachable to said upper attachment member when said lower attachment member is positioned adjacent to the top side of the open end of the sleeve and suction is applied to said upper attachment member, wherein the open end of the sleeve is expandable to facilitate insertion of the head portion of the stethoscope into the sleeve when the top side of the open end is moved upward away from the bottom side by said upper attachment member, wherein a user inserts the head portion of the stethoscope through said opening and upon completion of a vacuum-sealing cycle separates the individual sealed sleeve containing the head portion from the adjoining sleeve.

* * * * *